US011233301B2

(12) United States Patent
Wang et al.

(10) Patent No.: US 11,233,301 B2
(45) **Date of Patent: *Jan. 25, 2022**

(54) LIQUID CRYSTAL PHASE SHIFTER AND ANTENNA

(71) Applicant: Chengdu Tianma Micro-Electronics Co., Ltd., Chengdu (CN)

(72) Inventors: Donghua Wang, Chengdu (CN); Yingru Hu, Chengdu (CN); Bo Wu, Chengdu (CN)

(73) Assignee: CHENGDU TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/958,750

(22) PCT Filed: May 21, 2019

(86) PCT No.: PCT/CN2019/087675

§ 371 (c)(1),
(2) Date: Jun. 29, 2020

(87) PCT Pub. No.: WO2020/015450

PCT Pub. Date: Jan. 23, 2020

(65) Prior Publication Data

US 2021/0135327 A1 May 6, 2021

(30) Foreign Application Priority Data

Jul. 20, 2018 (CN) ..... 201810804419.0

(51) Int. Cl.

| | |
|---|---|
| ***H01P 1/18*** | (2006.01) |
| ***H01Q 1/22*** | (2006.01) |
| ***H01Q 3/36*** | (2006.01) |

(52) U.S. Cl.
CPC ..... *H01P 1/184* (2013.01); *H01Q 1/22* (2013.01); *H01Q 3/36* (2013.01)

(58) Field of Classification Search
CPC ..... H01P 1/184; H01Q 1/22; H01Q 3/36
See application file for complete search history.

(56) References Cited

U.S. PATENT DOCUMENTS 5,537,242 A 7/1996 Lim
10,141,620 B2 * 11/2018 Jakoby ..... H01P 1/184
(Continued)

FOREIGN PATENT DOCUMENTS

CN 106125417 A 11/2016
CN 106532200 A 3/2017
(Continued)

*Primary Examiner* — Dinh T Le
(74) *Attorney, Agent, or Firm* — Kilpatrick Townsend & Stockton, LLP

(57) ABSTRACT

Provided is a liquid crystal phase shifter, including a first substrate and a second substrate opposite to the first substrate; a liquid crystal layer between the first and second substrates; phase-shifting units each including a microstrip line, a phased electrode and two feed terminals, the microstrip line is located between the first substrate and the liquid crystal layer, the phased electrode is located between the second substrate and the liquid crystal layer, the two feed terminals are located at a side of the first or second substrate facing away from the other, and in a direction perpendicular to the first substrate, two ends of the microstrip line respectively overlap the two feed terminals, the phased electrode includes at least two sub-electrodes spaced apart from each other, and the microstrip line includes effective line segments respectively corresponding to each sub-electrode, and the sub-electrodes covers a corresponding effective line segment.

20 Claims, 7 Drawing Sheets

(56) References Cited

U.S. PATENT DOCUMENTS

| | | | | |
|---|---|---|---|---|
| 10,819,006 | B2 * | 10/2020 | Misaki | H01L 23/66 |
| 2001/0017577 | A1 | 8/2001 | Toko et al. | |
| 2014/0022029 | A1 | 1/2014 | Glushchenko et al. | |
| 2018/0138593 | A1 * | 5/2018 | Nakazawa | G02F 1/292 |

FOREIGN PATENT DOCUMENTS

| | | | |
|---|---|---|---|
| CN | 106940502 | A | 7/2017 |
| CN | 107994302 | A | 5/2018 |
| CN | 108181745 | A | 6/2018 |
| CN | 108196405 | A | 6/2018 |
| CN | 108808181 | A | 11/2018 |
| EP | 2956986 | A1 | 12/2015 |

* cited by examiner

LIQUID CRYSTAL PHASE SHIFTER AND ANTENNA

The present application is a U.S. National Stage of International Application No. PCT/CN2019/087675, filed May 21, 2019, which claims priority to Chinese Patent Application No. 201810804419.0, filed on Jul. 20, 2018 and entitled "Liquid Crystal Phase Shifter and Antenna", the contents of both of which are incorporated herein by reference in its entirety.

FIELD

The present disclosure relates to the field of electromagnetic wave technologies and, in particular, to a liquid crystal phase shifter and an antenna.

BACKGROUND

A phase shifter is a device that can adjust phases of an electromagnetic wave, and it is widely used in fields such as radars, spacecraft attitude control, accelerators, communications, instruments, and even music.

With the development of technology, a new liquid crystal phase shifter has appeared. However, in current designs of liquid crystal phase shifter, if carrier frequencies of the liquid crystal phase shifter needs to be adjusted, then it is necessary to use a new liquid crystal phase shifter, that is, compatibility of the liquid crystal phase shifter is poor.

SUMMARY

Embodiments of the present disclosure provide a liquid crystal phase shifter and an antenna, which can adjust carrier frequencies applicable to the liquid crystal phase shifter, improving the compatibility of the liquid crystal phase shifter.

Embodiments of the present disclosure provides a liquid crystal phase shifter, including:

a first substrate and a second substrate disposed opposite to the first substrate; a liquid crystal layer provided between the first substrate and the second substrate; and at least one phase-shifting unit, and each of the at least one phase-shifting unit includes a microstrip line, a phased electrode and two feed terminals, the microstrip line is located between the first substrate and the liquid crystal layer, the phased electrode is located between the second substrate and the liquid crystal layer, the two feed terminals are located at a side of the first substrate facing away from the second substrate or at a side of the second substrate facing away from the first substrate, and in a direction perpendicular to a plane of the first substrate, two ends of the microstrip line respectively overlap the two feed terminals, and the phased electrode includes at least two sub-electrodes spaced apart from each other, and the microstrip line includes effective line segments respectively corresponding to each of the at least two sub-electrodes, and in the direction perpendicular to the plane of the first substrate, each of the at least two sub-electrodes covers a corresponding one of the effective line segments.

Embodiments of the present disclosure further provides an antenna including a liquid crystal phase shifter, the liquid crystal phase shifter includes: a first substrate and a second substrate disposed opposite to the first substrate; a liquid crystal layer provided between the first substrate and the second substrate; and at least one phase-shifting unit, wherein each of the at least one phase-shifting unit includes a microstrip line, a phased electrode and two feed terminals, the microstrip line is located between the first substrate and the liquid crystal layer, the phased electrode is located between the second substrate and the liquid crystal layer, the two feed terminals are located at a side of the first substrate facing away from the second substrate or at a side of the second substrate facing away from the first substrate, and in a direction perpendicular to a plane of the first substrate, two ends of the microstrip line respectively overlap the two feed terminals, wherein the phased electrode includes at least two sub-electrodes spaced apart from each other, and the microstrip line includes effective line segments respectively corresponding to each of the at least two sub-electrodes, and in the direction perpendicular to the plane of the first substrate, each of the at least two sub-electrodes covers a corresponding one of the effective line segments.

BRIEF DESCRIPTION OF DRAWINGS

In order to illustrate the embodiments of the present disclosure the drawings will be briefly introduced below.

DESCRIPTION OF EMBODIMENTS

The terms used in the embodiments of the present disclosure are merely for the purpose of describing particular embodiments and not intended to limit the present disclosure. Unless the context indicates other meanings, the singular form expressions "a", "an", "said" and "the" used in the embodiments and appended claims of the present disclosure are also intended to represent the plural form.

Figure 1:
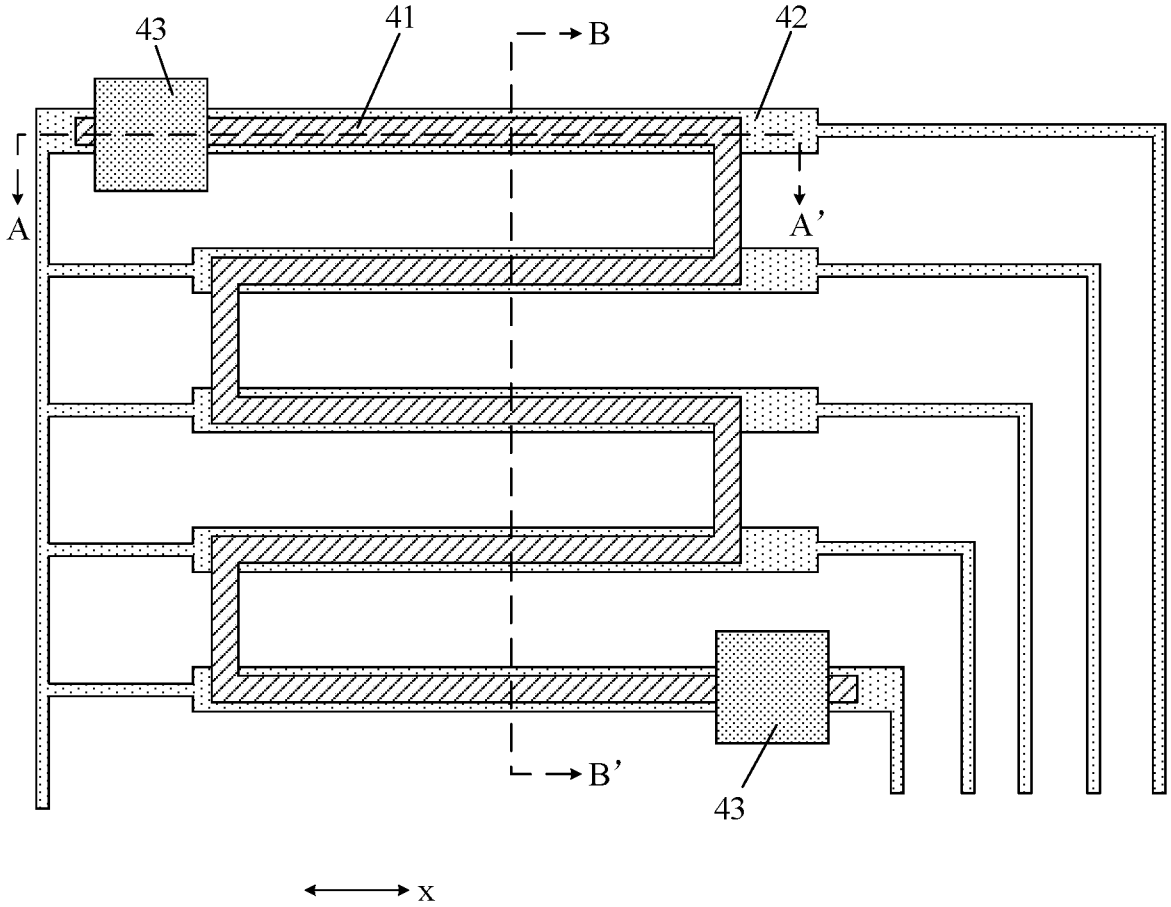
FIG. 1 illustrates a top diagram of a liquid crystal phase shifter in an embodiment of the present disclosure.
Figure 2:
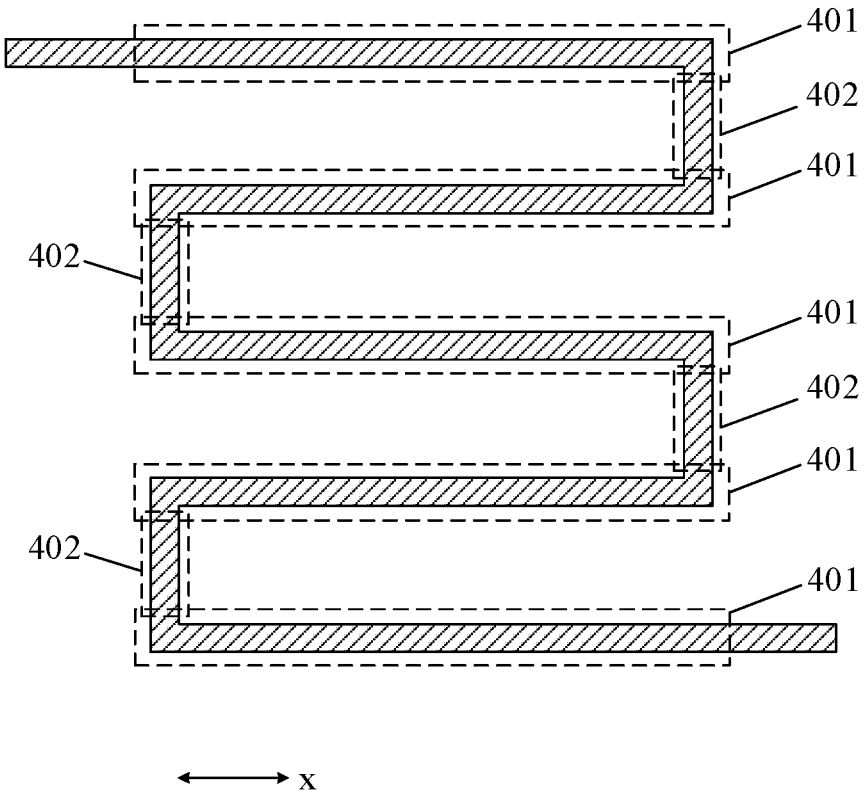
FIG. 2 illustrates a structural schematic diagram of a microstrip line in FIG. 1.
Figure 3:
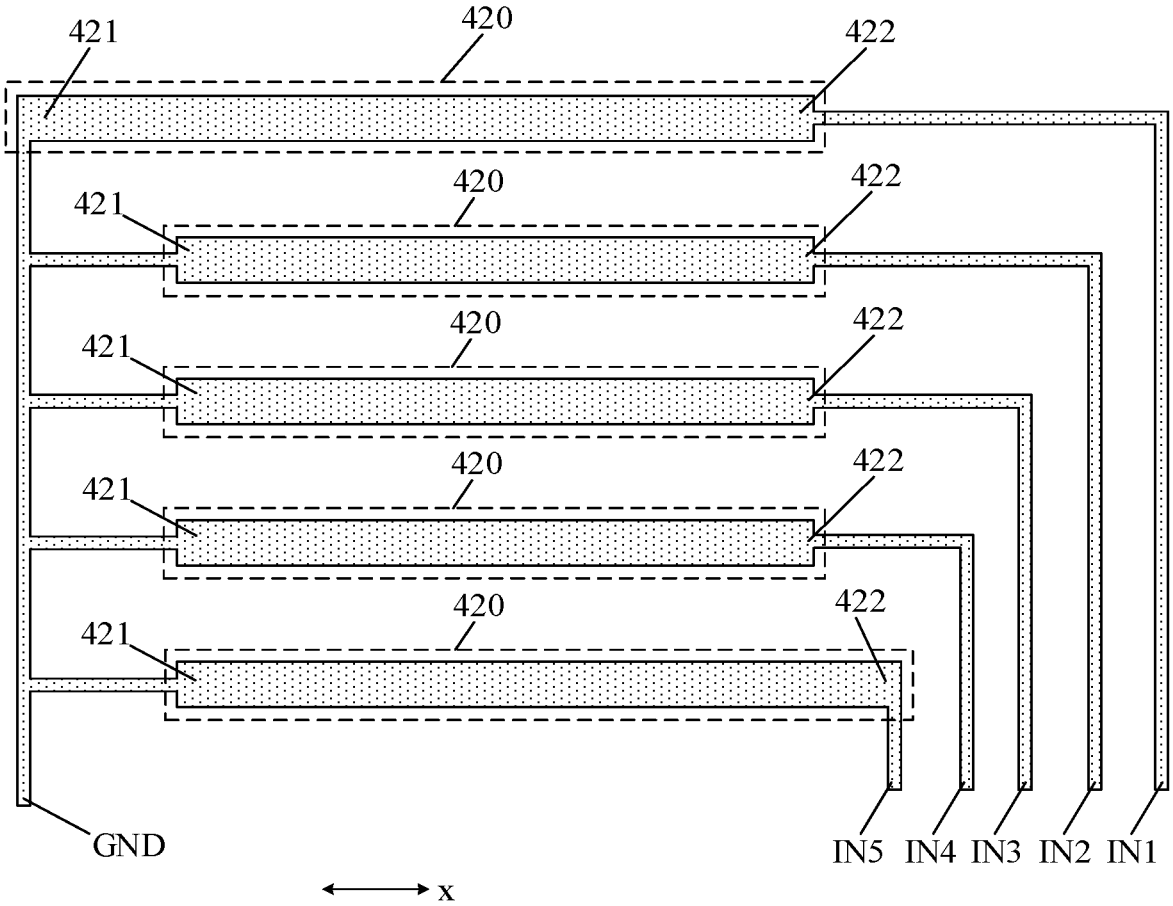
FIG. 3 illustrates a structural schematic diagram of a phased electrode in FIG. 1.
Figure 4:
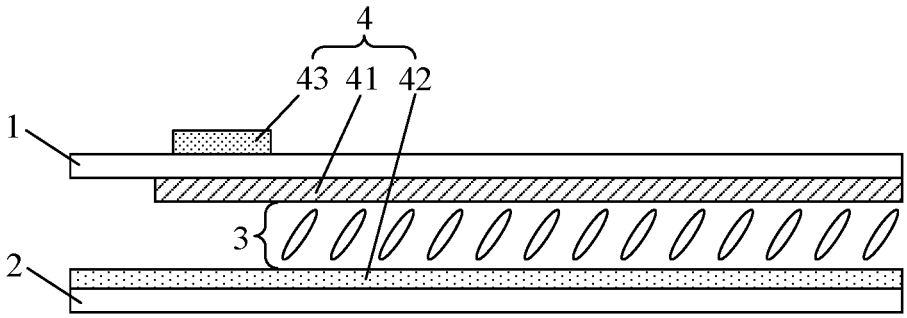
FIG. 4 illustrates a cross-sectional structural schematic diagram taken along an AA' direction in FIG. 1.
Figure 5:
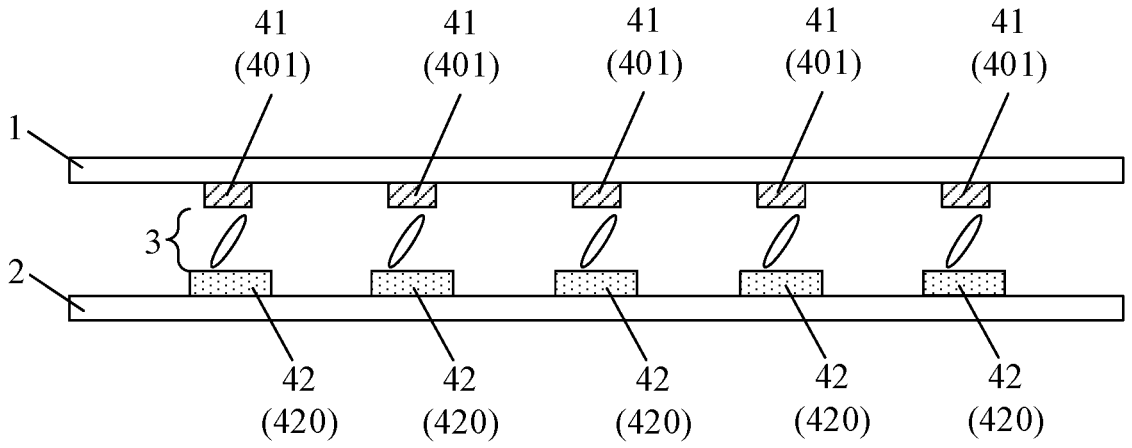
FIG. 5 illustrates a cross-sectional structural schematic diagram taken along a BB' direction in FIG. 1.
Figure 6:
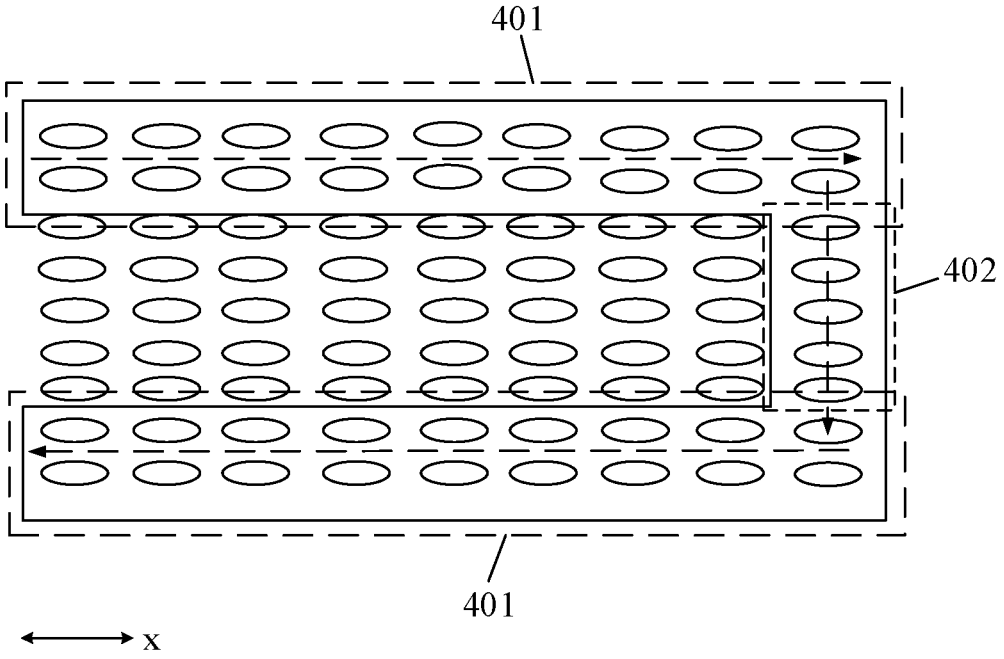
FIG. 6 illustrates a schematic diagram of an arrangement of liquid crystals in some regions under a non-operating state of the liquid crystal phase shifter in FIG. 1.

As shown in FIG. 1, FIG. 2, FIG. 3, FIG. 4, and FIG. 5, FIG. 1 illustrates a top diagram of a liquid crystal phase shifter in an embodiment of the present disclosure, FIG. 2 illustrates a structural schematic diagram of a microstrip line in FIG. 2, FIG. 3 illustrates a structural schematic diagram of a phased electrode in FIG. 1, FIG. 4 illustrates a cross-sectional structural schematic diagram in an AA' direction in FIG. 1, and FIG. 5 illustrates a cross-sectional structural schematic diagram of a in a BB' direction in FIG. 1. An embodiment of the present disclosure provides a liquid crystal phase shifter, and the liquid crystal phase shifter includes: a first substrate 1 and a second substrate 2 disposed opposite to the first substrate 1, and a liquid crystal layer 3 located between the first substrate 1 and the second substrate 2; at least one phase-shifting unit 4. The phase-shifting unit 4 includes a microstrip line 41, a phased electrode 42, and two feed terminals 43. The microstrip line 41 is located between the first substrate 1 and the liquid crystal layer 3, and the phased electrode 42 is located between the second substrate 2 and the liquid crystal layer 3. The two feed terminals 43 are located at a side of the first substrate 1 facing away from the second substrate 2 or at a side of the second substrate 2 facing away from the first substrate 1. In a direction perpendicular to a plane of the first substrate 1, two ends of the microstrip line 41 respectively overlap the two feed terminals 43. The phased electrode 42 includes at least two sub-electrodes 420 spaced apart from each other, and the microstrip line 41 includes an effective line segment 401 corresponding to each of the sub-electrodes 420. In the direction perpendicular to the plane of the first substrate 1, each of the sub-electrodes 420 covers the corresponding effective line segment 401.

In one embodiment, during operation of the liquid crystal phase shifter, voltage signals are respectively applied to the microstrip line 41 and the phased electrode 42, to form an electric field between the microstrip line 41 and the phased electrode 42, and the electric field drives the liquid crystals in the liquid crystal layer 3 to be deflected. The microstrip line 41 is configured to transmit a microwave signal, and the microwave signal is transmitted between the microstrip line 41 and the phased electrode 42. During the transmission of the microwave signal, the phase will be changed due to deflection of the liquid crystals, achieving a phase-shifting function of the microwave signal. The phase-shifting of the microwave is to utilize a change of electrical characteristics of the deflected liquid crystals, and a carrier frequency applicable to the phase-shifting unit is related to a transmission distance of the microwave in the deflected liquid crystals. The microstrip line 41 is configured for the transmission of the microwave signal while performing the phase-shifting during the transmission process, and the feed terminal 43 is configured to cooperate with the two ends of the microstrip line 41 to realize feeding in and feeding out of the microwave signal on the microstrip line 41. In the embodiments of the present disclosure, the phased electrode 42 includes a plurality of sub-electrodes 420 spaced apart from each other, and each of the sub-electrodes 420 corresponds to one effective line segment 401. Since different sub-electrodes 420 are independent from each other, during the operation of the liquid crystal phase shifter, it is possible to control which sub-electrodes 420 are applied with a voltage and which sub-electrodes 420 are not applied with a voltage. The liquid crystals between the sub-electrode 420 with voltage applied and the corresponding effective line segment 401 will be deflected, and the liquid crystals between the sub-electrode 420 without voltage applied and the corresponding effective line segment 401 will not be deflected. In the transmission path of the microwave signal, the undeflected liquid crystals will not play a role of phase-shifting, and only the deflected liquid crystals will play the role of phase-shifting. Therefore, when selecting to apply voltages to different numbers of sub-electrodes 420, during the microwave transmission, effective path lengths of the phase-shifting of the microwave by using the deflected liquid crystals are different. That is, it can be achieved that the liquid crystal phase shifter can be adapted to different carrier frequencies.

For the liquid crystal phase shifter in the embodiments of the present disclosure, the phased electrode includes a plurality of sub-electrodes spaced apart from each other, and each of the sub-electrodes corresponds to one effective line segment. Since different sub-electrodes are independent from each other, during the operation of the liquid crystal phase shifter, it is possible to control which sub-electrodes are applied with a voltage and which sub-electrodes are not applied with a voltage. The liquid crystals between the sub-electrode with voltage applied and the corresponding effective line segment will be deflected, and the liquid crystals between the sub-electrode without voltage applied and the corresponding effective line segment will not be deflected. In the transmission path of the microwave signal, the undeflected liquid crystals will not play a role of phase-shifting, and only the deflected liquid crystals will play the role of phase-shifting. Therefore, when selecting to apply voltages to different numbers of sub-electrodes, during the microwave transmission, effective path lengths of the phase-shifting of the microwave by using the deflected liquid crystals are different. That is, it can be achieved that the liquid crystal phase shifter can be adapted to different carrier frequencies. However, in the related art, the microstrip line of the liquid crystal phase shifter only corresponds to two feed terminals, resulting it impossible to adjust the applied carrier frequency. Therefore, the embodiments of the present disclosure improve compatibility of the liquid crystal phase shifter.

Figure 7:
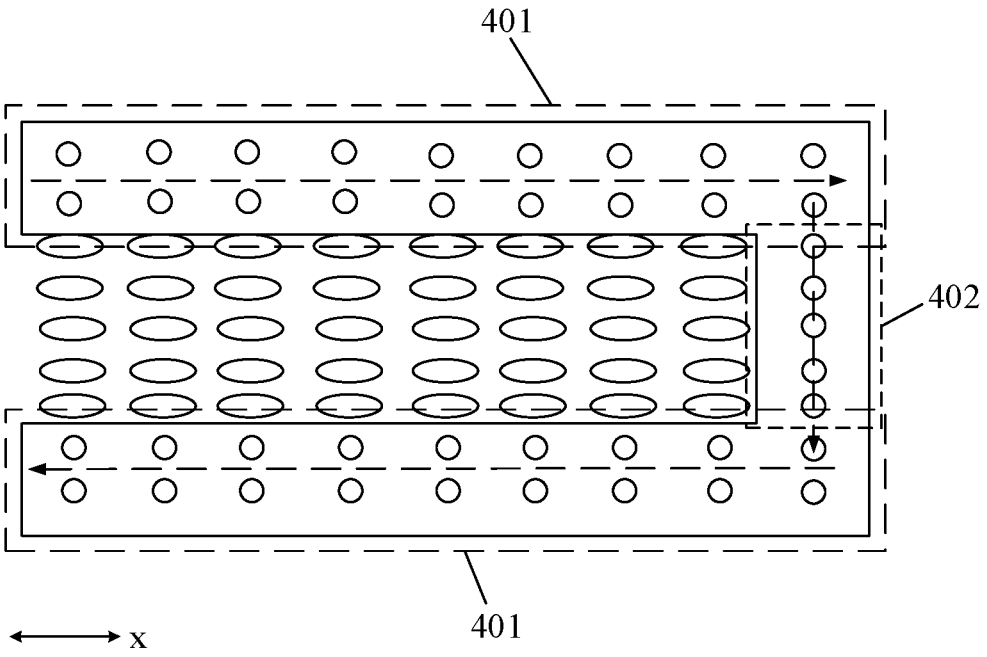
FIG. 7 illustrates a schematic diagram of an arrangement of liquid crystals in some regions under an operating state of the liquid crystal phase shifter in FIG. 1.

In one embodiment, as shown in FIG. 1, FIG. 2, FIG. 3, FIG. 4, FIG. 5, FIG. 6, and FIG. 7, FIG. 6 is a schematic diagram of an arrangement of liquid crystals in some regions under a non-operating state of the liquid crystal phase shifter in FIG. 1, FIG. 7 is a schematic diagram of an arrangement of liquid crystals in some regions under an operating state of the liquid crystal phase shifter in FIG. 1, and each effective line segment 401 extends along an initial alignment direction x of the liquid crystal layer.

In one embodiment, taking positive liquid crystal molecules as an example, in the non-operating state, no electric field is formed between the phased electrode 42 and the microstrip line 41 in the liquid crystal phase shifter, and long axes of the liquid crystal molecules in the liquid crystal layer 3 extend and are arranged along the initial alignment direction x of the liquid crystal layer. In the operating state, an electric field is formed between the sub-electrode 420 with voltage applied and the microstrip line 41 in the liquid crystal phase shifter, no electric field is formed between the sub-electrode 420 without voltage applied and the microstrip line 41, the liquid crystals between the sub-electrode 420 with voltage applied and the microstrip line 41 are deflected, the liquid crystals between the sub-electrode 420 without voltage applied and the microstrip line 41 are not deflected, and the microwave transmitted along the extending path of the microstrip line 41 utilizes the change in the electrical characteristics of the deflected liquid crystals to achieve phase-shifting. Dotted arrows in FIG. 6 and FIG. 7 denote the microwave transmission paths. For the microwave transmission path corresponding to the sub-electrode 420 with voltage applied, the liquid crystals before deflection corresponds to dielectric properties of the long axes of the liquid crystal molecules, the deflected liquid crystals corresponds to dielectric properties of short axes of the liquid crystal molecules. Therefore, in the operating state of the liquid crystal phase shifter, the sub-electrode 420 with voltage applied and the effective line segment 401 correspond to the effective path of the phase-shifting of the microwave, and an optimal liquid crystal phase-shifting function can be realized, while in the non-operating state, the liquid crystal phase shifter cannot realize the liquid crystal phase-shifting function.

It should be noted that the initial alignment direction x of the liquid crystal layer is not limited to the manner shown in the drawing, and other angles can also be selected, as long as it can ensure that the effective line segment 401 plays a leading role in the phase adjustment of the microwave signal. The initial alignment direction x of the liquid crystal layer can be configured by a liquid crystal alignment layer. For example, in the structures shown in FIGS. 4 and 5, a liquid crystal alignment layer is provided between the liquid crystal layer 3 and the microstrip line 41, a liquid crystal alignment layer is provided between the liquid crystal layer 3 and the phased electrode 42, and when the liquid crystal phase shifter is in the non-operating state, the long axes of the liquid crystal molecules in the liquid crystal layer 3 extend along the initial alignment direction x of the liquid crystal layer under the action of the liquid crystal alignment layer. It can be understood that the liquid crystal molecules in the embodiments of the present disclosure may also be negative liquid crystal molecules, and there is no specific limitation on types of liquid crystal molecules in the present disclosure.

In one embodiment, the microstrip line 41 further includes non-effective line segments 402 connected between any two adjacent effective line segments 401, and each of the non-effective line segments 402 extends along a direction other than the initial alignment direction of the liquid crystal layer.

In one embodiment, in the microwave transmission path corresponding to the non-effective line segment 402, the liquid crystals before and after the deflection correspond to the dielectric properties of the short axes of the liquid crystal molecules, so when the liquid crystal phase shifter is in the operating state, the non-effective line segment 402 corresponds to the non-effective path of the phase-shifting of the microwave, and the liquid crystal phase-shifting function cannot be achieved. By respectively providing the effective line segment 401 extending along the initial alignment direction x of the liquid crystal layer and the non-effective line segment 402 extending along a direction other than the initial alignment direction of the liquid crystal layer, configuration of the shape of the overall microstrip line 41 can be more flexible, to realize more reasonable space utilization.

In one embodiment, the extending direction of each non-effective line segment 402 is the same, which facilitates configuration of a serpentine transmission part 412 to utilize the space more efficiently.

In one embodiment, the extending direction of each non-effective line segment 402 is perpendicular to the initial alignment direction x of the liquid crystal layer, so that it is possible to ensure to the greatest extent when the liquid crystals corresponding to the non-effective line segment 402 are deflected, they will not play the role of liquid crystal phase-shifting, to more accurately adjust an effective path length of the phase-shifting of the microwave.

In one embodiment, any two adjacent effective line segments 401 and the non-effective line segment 402 connecting the two form a U-shaped structure, achieving a serpentine microstrip line 41, to utilize the space more efficiently.

In one embodiment, a first pole 421 of each sub-electrode 420 is electrically connected to a fixed potential. For example, the first pole 421 of each sub-electrode 420 is grounded GND.

In one embodiment, second poles 422 of at least two sub-electrodes 420 are respectively connected to different input terminals.

In one embodiment, the second electrodes 422 of the five sub-electrodes 420 from top to bottom in FIG. 3 are respectively connected to a first input terminal IN1, a second input terminal IN2, a third input terminal IN3, a fourth input terminal IN4 and a fifth input terminal IN5. According to requirements of the carrier frequency, when only a path corresponding to the first sub-electrode 420 is used as an effective path for phase-shifting of the microwave, an input voltage is applied to the first input terminal IN1, to cause a passage to be formed between the first input terminal IN1 and the ground GND through the first sub-electrode 420, to make the first sub-electrode 420 to have a voltage thereon, so that an electric field is formed between the first sub-electrode 420 and the corresponding effective line segment 401 to drive the liquid crystals to be deflected, realizing the liquid crystal phase-shifting function, while no voltage is applied to the second input terminal IN2, the third input terminal IN3, the fourth input terminal IN4 and the fifth input terminal IN5, that is, the second sub-electrode 420, the third sub-electrode 420, the fourth sub-electrode 420 and the fifth sub-electrode 420 have no voltage thereon, thus no electric field will be formed between them and the corresponding effective line segment 401, and the liquid crystals corresponding thereto will not be deflected, and the length of the effective path for the phase-shifting of the microwave is the length of the effective line segment 401 corresponding to the first sub-electrode 420. According to the requirements of the carrier frequency, when only the path corresponding to the first two sub-electrodes 420 is used as the effective path for the phase-shifting of the microwave, an input voltage is applied to the first input terminal IN1 and the second input terminal IN2, to cause a passage to be formed between the first input terminal IN1 and the ground GND through the first sub-electrode 420 and to cause a passage to be formed between the second input terminal IN2 and the ground GND through the second sub-electrode 420, so that the first sub-electrode 420 and the second sub-electrode 420 have a voltage thereon, and the two sub-electrodes 420 respectively form electric fields with the corresponding effective line segments 401, to drive the liquid crystals therein to be deflected to realize the liquid crystal phase-shifting function, while no voltage is applied to the third input terminal IN3, the fourth input terminal IN4, and the fifth input terminal IN5, that is, the third sub-electrode 420, the fourth sub-electrode 420, and the fifth sub-electrode 420 do not have a voltage thereon, thus no electric field will be formed between them and the corresponding effective line segments 401, and the liquid crystals corresponding thereto will not be deflected. Further situations can be deduced by analogy.

Figure 8:
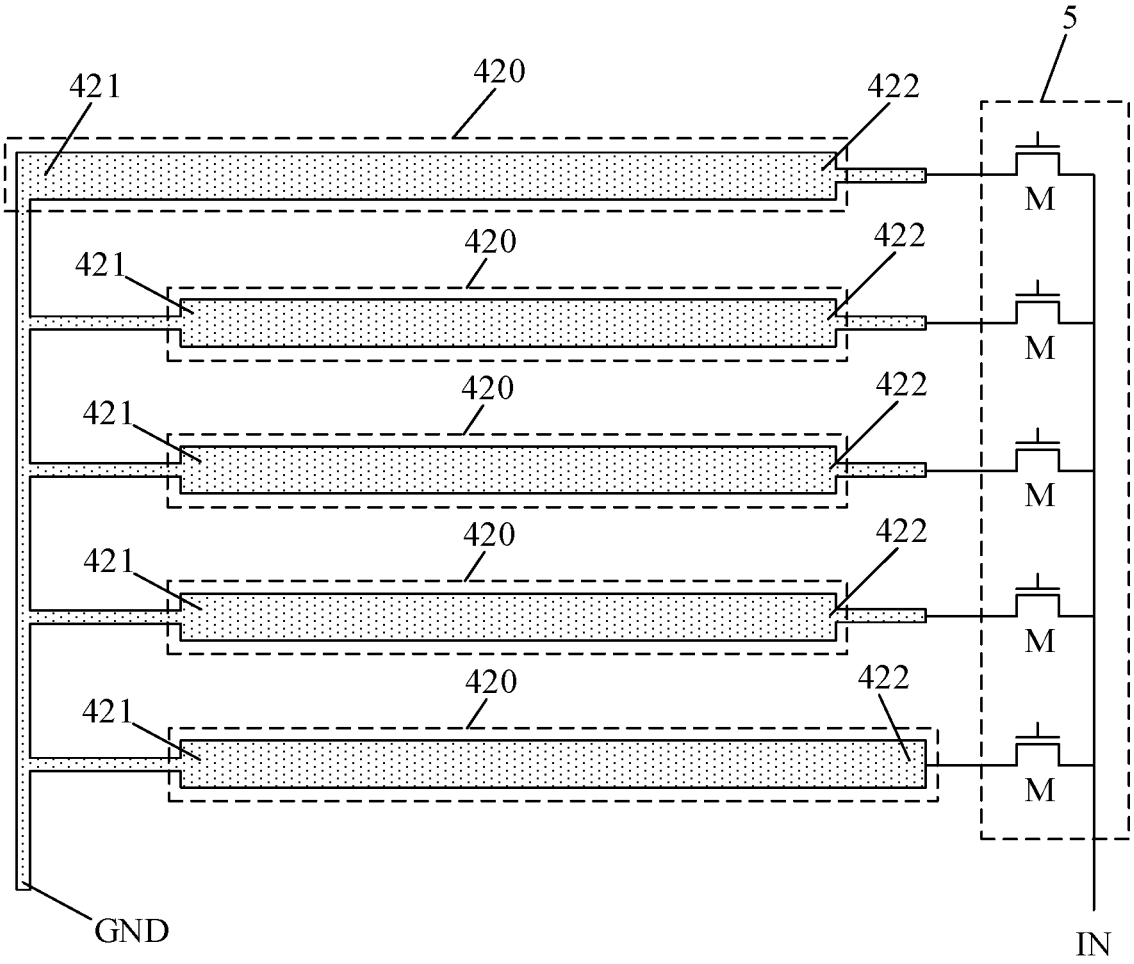
FIG. 8 illustrates a schematic diagram showing a connection of phased electrodes in an embodiment of the present disclosure.

In one embodiment, as shown in FIG. 8, FIG. 8 is a schematic diagram of connection of another phased electrode according to an embodiment of the present disclosure. The second poles 422 of at least two sub-electrodes 420 are connected to the same input terminal IN through a gating circuit 5. Through the gating circuit 5, it is possible to control which sub-electrodes 420 have their second poles 422 conducted with the input terminal IN and which sub-electrodes 420 have their second poles 422 cut off from the input terminal IN, and it is also possible to achieve the adjustment of the effective path length for the phase-shifting of the microwave by controlling the application of voltages to different sub-electrodes 420.

In one embodiment, the gating circuit 5 includes a switch transistor M corresponding to each second pole 422, each second pole 422 is connected to the input terminal IN through a corresponding switch transistor M, a first terminal of each switch transistor M is connected to the corresponding second pole 422, a second terminal of each switch transistor M is connected to the input terminal IN, and a control terminal of each switch transistor M is configured to control conduction or cutting-off between the first terminal and the second terminal of the switch transistor M. By controlling the conduction or cutting-off of each of the switch transistors M respectively, it is possible to control which sub-electrodes 420 have their second poles 422 conducted with the input terminal IN and which sub-electrodes 420 have their second poles 422 cut off from the input terminal IN, realizing the adjustment of the effective path length for the phase-shifting of the microwave.

Figure 9:
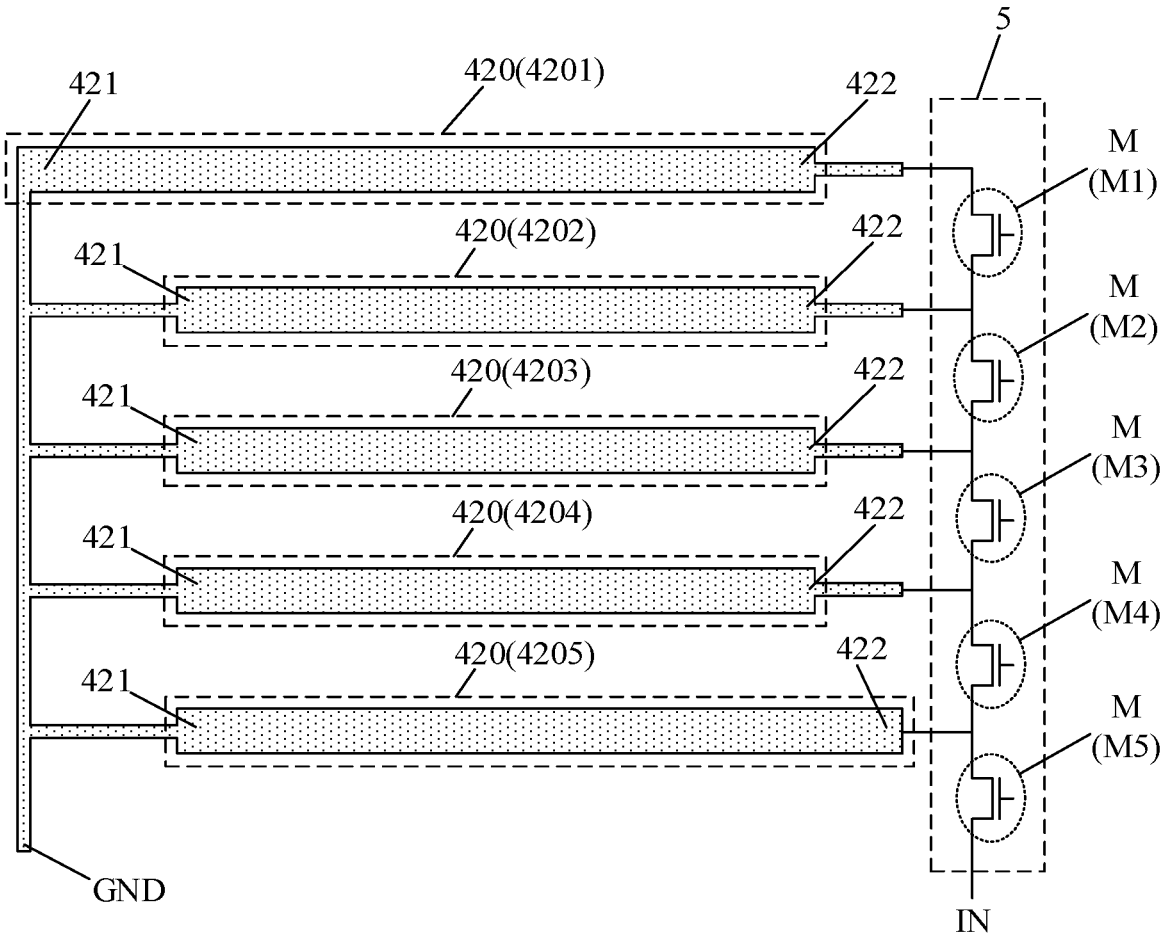
FIG. 9 illustrates a schematic diagram showing another connection of phased electrodes in an embodiment of the present disclosure.

In one embodiment, as shown in FIG. 9, FIG. 9 is a schematic diagram of connection of another phased electrode according to an embodiment of the present disclosure. At least two sub-electrodes 420 include n sub-electrodes 420, and the gating circuit 5 includes n switch transistors M, where n is an integer greater than 1; the second pole 422 of the $i^{th}$ sub-electrode 420 is connected to the second pole 422 of the $(i+1)^{th}$ sub-electrode 420 through the $i^{th}$ switch transistor M, a value of i is 1, 2, 3, . . . , n−1, and the second pole 422 of the $n^{th}$ sub-electrode 420 is connected to the input terminal IN through the $n^{th}$ switch transistor M.

In one embodiment, for example, in the structure shown in FIG. 9, n=5, five sub-electrodes 420 from top to bottom are the first to fifth sub-electrodes 4201 to 4205, five switch transistors M from top to bottom are the first to the fifth switch transistors M1 to M5, the second pole 422 of the first sub-electrode 4201 is connected to the second pole 422 of the second sub-electrode 4202 through the first switch transistor M1, and the second pole 422 of the second sub-electrode 4202 is connected to the second pole 422 of the third sub-electrode 4203 through the second switch transistor M2. By analogy, the last sub-electrode, that is, the second pole 422 of the fifth sub-electrode 4205 is connected to the input terminal IN through the fifth switch transistor M5. Through controlling the switch transistor M, it is also possible to control the application of voltages to different numbers of sub-electrodes 420, to achieve the adjustment of the effective path length for the phase-shifting of the microwave. For example, when all five switch transistors M are controlled to be conducted, voltages can be applied to the five sub-electrodes 420; when controlling the second to fifth switch transistors M to be conducted and the first switch transistor M to be cut off, voltages can be applied to the four sub-electrodes 420; when controlling the third to fifth switch transistors M to be conducted and the first and second switch transistors M to be cut off, voltages can be applied to the three sub-electrodes 420; by analogy, voltages can be applied to different numbers of sub-electrodes 420.

It should be noted that the liquid crystal phase shifter in the embodiments of the present disclosure only illustrates one phase-shifting unit 4. In other implementable embodiments, one liquid crystal phase shifter includes a plurality of phase-shifting units distributed in an array, and the phased electrodes of the plurality of phase-shifting units are connected to each other, so that all the phased electrodes have the same potential. Each phase-shifting unit is configured to realize the phase-shifting function of one microwave signal. Each phase-shifting unit can be respectively made as a different liquid crystal cell, and it is also possible to make all the phase-shifting units into the same one liquid crystal cell. In addition, in the embodiments of the present disclosure, the feed terminal 43 may be a part of the feed line, and the feed line is configured to realize the microwave signal transmission between the feed terminal 43 and other components. For example, in an application scenario of an antenna, a radiating unit of the antenna is connected to the feed terminal 43 through the feed line, after the liquid crystal phase shifter completes the phase-shifting, the microwave signal is fed from the microstrip line 41 to the feed terminal 43, the feed terminal 43 transmits the phase-shifted microwave signal to the radiating unit through the feed line, and the radiating unit radiates the microwave signal, to realize an antenna function.

An embodiment of the present disclosure further provides an antenna including the above liquid crystal phase shifter. The liquid crystal phase shifter is configured to realize the phase-shifting function of the microwave signal in the antenna.

The specific structure and principle of the liquid crystal phase shifter are the same as those in the above embodiments and will not be repeated here.

For the antenna in the embodiments of the present disclosure, the phased electrode of the liquid crystal phase shifter includes a plurality of sub-electrodes spaced apart from each other, each sub-electrode corresponds to one effective line segment. Since different sub-electrodes are independent from each other, during the operation of the liquid crystal phase shifter, it is possible to respectively control which sub-electrodes are applied with a voltage and which sub-electrodes are not applied with a voltage. The liquid crystals between the sub-electrode with voltage applied and the corresponding effective line segment will be deflected, and the liquid crystals between the sub-electrode without voltage applied and the corresponding effective line segment will not be deflected. In the transmission path of the microwave signal, the undeflected liquid crystals will not play the role of phase-shifting, and only the deflected liquid crystals will play the role of phase-shifting, so when a voltage is applied to different numbers of sub-electrodes, the effective path lengths for phase-shifting of the microwave by using the deflected liquid crystals are different during microwave transmission, that is, the liquid crystal phase shifter can be adapted to different carrier frequencies. However, in the related art, the microstrip line of the liquid crystal phase shifter only corresponds to two feed terminals, and the applicable carrier frequency cannot be adjusted. Therefore, the embodiments of the present disclosure improve the compatibility of the liquid crystal phase shifter.

What is claimed is:

1. A liquid crystal phase shifter, comprising:

a first substrate and a second substrate disposed opposite to the first substrate;

a liquid crystal layer provided between the first substrate and the second substrate; and at least one phase-shifting unit, wherein each of the at least one phase-shifting unit comprises a microstrip line, a phased electrode and two feed terminals, the microstrip line is located between the first substrate and the liquid crystal layer, the phased electrode is located between the second substrate and the liquid crystal layer, the two feed terminals are located at a side of the first substrate facing away from the second substrate or at a side of the second substrate facing away from the first substrate, and in a direction perpendicular to a plane of the first substrate, two ends of the microstrip line respectively overlap the two feed terminals, wherein the phased electrode comprises at least two sub-electrodes spaced apart from each other, and the microstrip line comprises effective line segments respectively corresponding to each of the at least two sub-electrodes, and in the direction perpendicular to the plane of the first substrate, each of the at least two sub-electrodes covers a corresponding one of the effective line segments.

2. The liquid crystal phase shifter according to claim 1, wherein each of the effective line segments extends along an initial alignment direction of the liquid crystal layer.

3. The liquid crystal phase shifter according to claim 2, wherein the microstrip line further comprises non-effective line segments connected each between any two adjacent ones of a plurality of effective line segments, and each of the non-effective line segments extends in a direction other than the initial alignment direction of the liquid crystal layer.

4. The liquid crystal phase shifter according to claim 3, wherein each of the non-effective line segments extends along a same direction.

5. The liquid crystal phase shifter according to claim 4, wherein each of the non-effective line segments extends along a direction perpendicular to the initial alignment direction of the liquid crystal layer.

6. The liquid crystal phase shifter according to claim 5, wherein any two adjacent ones of the effective line segments and one of the non-effective line segments connecting the two form a U-shaped structure.

7. The liquid crystal phase shifter according to claim 1, wherein a first pole of each of the at least two sub-electrodes is electrically connected to a fixed potential.

8. The liquid crystal phase shifter according to claim 1, wherein second poles of the at least two sub-electrodes are respectively connected to different input terminals.

9. The liquid crystal phase shifter according to claim 1, wherein second poles of the at least two sub-electrodes are connected to an input terminal through a gating circuit.

10. The liquid crystal phase shifter according to claim 9, wherein the gating circuit comprises switch transistors each corresponding to one of the second poles, and each of the second poles is connected to the input terminal through a corresponding one of the switch transistors.

11. The liquid crystal phase shifter according to claim 9, wherein the at least two sub-electrodes comprise n sub-electrodes, and the gating circuit comprises n switch transistors, where n is an integer greater than 1;

a second pole of an $i^{th}$ sub-electrode is connected to a second pole of an $(i+1)^{th}$ sub-electrode through an $i^{th}$ switch transistor, i is 1, 2, 3, . . . , or n−1, and a second pole of an $n^{th}$ sub-electrode is connected to the input terminal through an $n^{th}$ switch transistor.

12. An antenna, comprising a liquid crystal phase shifter, wherein the liquid crystal phase shifter comprises:

a first substrate and a second substrate disposed opposite to the first substrate;

a liquid crystal layer provided between the first substrate and the second substrate; and at least one phase-shifting unit, wherein each of the at least one phase-shifting unit comprises a microstrip line, a phased electrode and two feed terminals, the microstrip line is located between the first substrate and the liquid crystal layer, the phased electrode is located between the second substrate and the liquid crystal layer, the two feed terminals are located at a side of the first substrate facing away from the second substrate or at a side of the second substrate facing away from the first substrate, and in a direction perpendicular to a plane of the first substrate, two ends of the microstrip line respectively overlap the two feed terminals, wherein the phased electrode comprises at least two sub-electrodes spaced apart from each other, and the microstrip line comprises effective line segments respectively corresponding to each of the at least two sub-electrodes, and in the direction perpendicular to the plane of the first substrate, each of the at least two sub-electrodes covers a corresponding one of the effective line segments.

13. The antenna according to claim 12, wherein each of the effective line segments extends along an initial alignment direction of the liquid crystal layer.

14. The antenna according to claim 13, wherein the microstrip line further comprises non-effective line segments connected each between any two adjacent ones of a plurality of effective line segments, and each of the non-effective line segments extends in a direction other than the initial alignment direction of the liquid crystal layer.

15. The antenna according to claim 14, wherein each of the non-effective line segments extends along a same direction.

16. The antenna according to claim 12, wherein a first pole of each of the at least two sub-electrodes is electrically connected to a fixed potential.

17. The antenna according to claim 12, wherein second poles of the at least two sub-electrodes are respectively connected to different input terminals.

18. The antenna according to claim 12, wherein second poles of the at least two sub-electrodes are connected to an input terminal through a gating circuit.

19. The antenna according to claim 18, wherein the gating circuit comprises switch transistors each corresponding to one of the second poles, and each of the second poles is connected to the input terminal through a corresponding one of the switch transistors.

20. The antenna according to claim 18, wherein the at least two sub-electrodes comprise n sub-electrodes, and the gating circuit comprises n switch transistors, where n is an integer greater than 1;

a second pole of an $i^{th}$ sub-electrode is connected to a second pole of an $(i+1)^{th}$ sub-electrode through an $i^{th}$ switch transistor, i is 1, 2, 3, . . . , or n−1, and a second pole of an $n^{th}$ sub-electrode is connected to the input terminal through an $n^{th}$ switch transistor.

* * * * *